United States Patent [19]

DeHart

[11] Patent Number: 5,006,857

[45] Date of Patent: Apr. 9, 1991

[54] ASYMMETRICAL TRIANGULAR PATCH ANTENNA ELEMENT

[75] Inventor: Mark J. DeHart, Renton, Wash.

[73] Assignee: The Boeing Company, Seattle, Wash.

[21] Appl. No.: 391,478

[22] Filed: Aug. 9, 1989

[51] Int. Cl.[5] ..... H01Q 1/38

[52] U.S. Cl. ..... 343/700 MS; 343/853; 343/846

[58] Field of Search ..... 343/700 MS, 853, 846, 343/829

[56] References Cited

U.S. PATENT DOCUMENTS

| | | | |
|---|---|---|---|
| 3,478,362 | 11/1969 | Ricardi et al. | 343/769 |
| 3,501,767 | 3/1970 | Velez | 343/795 |
| 3,815,141 | 6/1974 | Kigler | 343/795 |
| 3,947,850 | 3/1976 | Kaloi | 343/795 |
| 3,972,049 | 7/1976 | Kaloi | 343/829 |
| 4,012,741 | 3/1977 | Johnson | 343/700 MS |
| 4,095,227 | 6/1978 | Kaloi | 343/700 MS |
| 4,125,838 | 11/1978 | Kaloi | 343/700 MS |
| 4,697,189 | 9/1987 | Ness | 343/700 MS |

*Primary Examiner*—Rolf Hille
*Assistant Examiner*—Hoanganh Le
*Attorney, Agent, or Firm*—Seed and Berry

[57] ABSTRACT

A planar microstrip antenna structure having individual elements in the form of asymmetrical triangular patches. The base of an equilateral triangular patch is rotated by some angle $\theta$ about its midpoint. The base angle $\theta$ is the angle of the base with respect to a perpendicular to the bisector of the angle adjacent the feedpoint of the triangle. Having the base at an angle $\theta$ produces an asymmetrical element radiation pattern. The element radiation pattern remains sufficiently strong near endfire to permit the main beam of the array to be swept through greater angles than previously possible.

19 Claims, 8 Drawing Sheets

ASYMMETRICAL TRIANGULAR PATCH ANTENNA ELEMENT

DESCRIPTION

1. Technical Field

This invention relates to a radio frequency antenna structure, and more particularly, to a low-profile antenna having an asymmetrical triangular patch antenna element. Radio waves transmitted by an aircraft must be often shaped, steered and scanned to perform a required function.

2. Background of the Invention

Numerous antenna structures, such as Yagi antennas, wave guides, notch antennas, and other nonplanar elements, permit the shaping and selective steering or scanning of a radio wave. However, such antennas are nonplanar. As a result, when such antennas are mounted on an aircraft they must be mounted behind an RF transparent dome or else project into the airstream. Either of these alternatives have various disadvantages and limitations. Antennas projecting into the airstream cause aerodynamic drag, are susceptible to icing and have a relatively large radar cross section, thus making such antennas unsuitable for modern tactical aircraft. Maintaining such antennas behind domes is often impractical because such antennas require more depth for implementation tan is practical for use in many aircraft. Also, space for such antennas is often not available in many aircraft.

Planar antennas, such as microstrip antennas, have been proposed for use on an aircraft structure. U.S. Pat. Nos. 4,125,838; 4,095,227; and 4,012,741 describe planar, circularly polarized microstrip antennas for mounting on an exterior surface of an aircraft. The planar microstrip antenna elements described in these patents provide the advantage of having a very low profile. The antenna elements can be fixed to the exterior surface of an aircraft and electronically coupled together to form an array and be thin enough to not affect the airfoil or body design of the aircraft. The significant disadvantage of known microstrip antennas is their limitation in permitting steering the beam or sweeping of the beam through a wide range of angles.

SUMMARY OF THE INVENTION

It is therefore an object of this invention to provide a planar microstrip antenna which permits the beam to be swept through a wider angle than previously possible.

It is another object of the present invention to provide a microstrip antenna element having an asymmetrical shape.

It is an object of this invention to provide a planar microstrip antenna structure which permits the beam to sweep greater than 70 degrees from boresight towards endfire.

These and other objects of the invention, as will be apparent herein, are accomplished by providing a planar microstrip antenna structure having a plurality of antenna elements. Each of the antenna elements has a triangular shape with three angles and three sides. One of the angles is approximately 60 degrees. The side opposite the 60-degree angle, referred to as the "base," is sloped at an angle with respect to the perpendicular of the bisector of the 60-degree angle.

Having the base sloped at a selected angle less than 90 degrees provides an element pattern having a significant beam squint. Further, the element pattern remains within 6 decibels until greater than 70 degrees from boresight, towards endfire. The beam of the array may thus be swept through angles greater than 70 degrees from boresight. Permitting the beam to scan greater than 70 degrees from boresight significantly increases the range of the radar.

BRIEF DESCRIPTION OF THE DRAWINGS

FIG. 4 is a polar graph of a prior art theoretical element pattern for the triangular patch antenna element of FIG. 3 with a steered beam sweeping through.

DETAILED DESCRIPTION OF THE INVENTION

Figure 2:
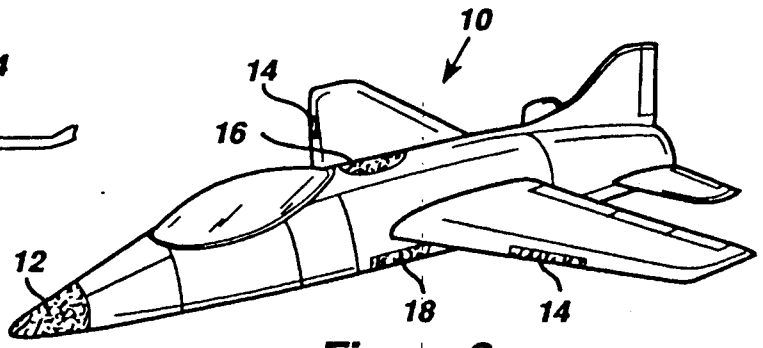
Figure 2 Prior Art
FIG. 2 is an isometric view of an aircraft having a variety of planar antennas fixed to the aircraft surface.

FIGS. 1–4 illustrate a prior art microstrip antenna array and the pattern produced by such an antenna array mounted on the underside of an aircraft. The antennas of the aircraft 10 include a fire control radar array 12 located at the nose of the aircraft and a fire control radar array 14 located on the wings. A Global Positioning System (GPS) array 16 is located along an upper part of the fuselage. An Electronic Support Measures (ESM) array 18 is located on an underside of the fuselage.

Figure 1:
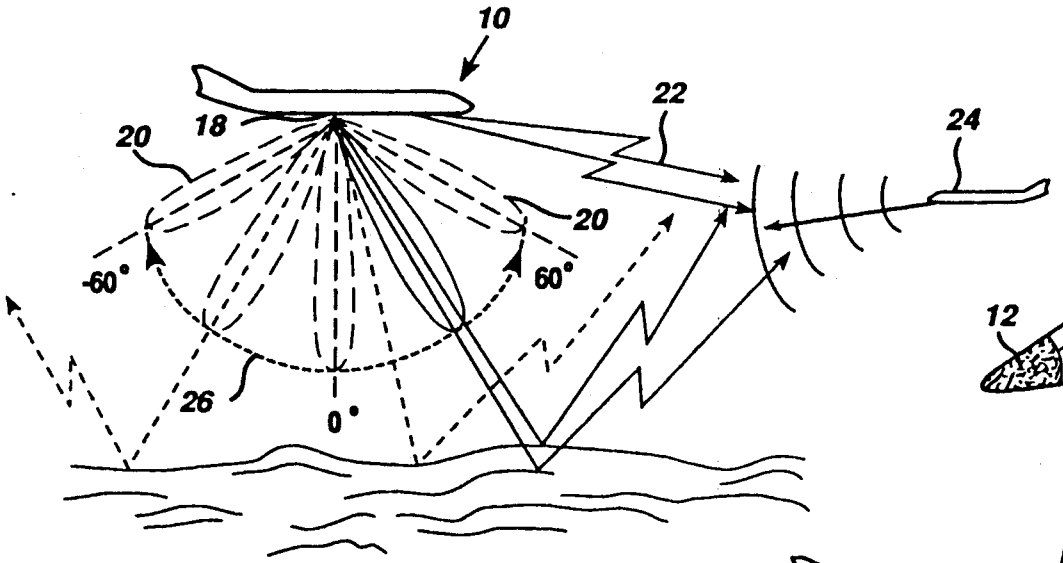
Figure 1 Prior Art
FIG. 1 is a side elevational view of an aircraft in flight illustrating the transmission of various radio waves.

As the aircraft 10 flies on a mission, each of the antennas transmit and/or receive signals, as best illustrated in FIG. 1. The ESM array 18 may direct a steered beam 20 towards the ground and sweep the steered beam 20 through a plurality of separate positions as the aircraft flies. The signals transmitted may be terrain bounce radar signals, electronic jamming signals for round-based enemy surface-to-air missile locations, fire control radar signals, or the like.

Sweeping the steered array beam 20 through an arc 26 permits the terrain well ahead of the aircraft as well as below and behind the aircraft to be repeatedly scanned.

Figure 3:
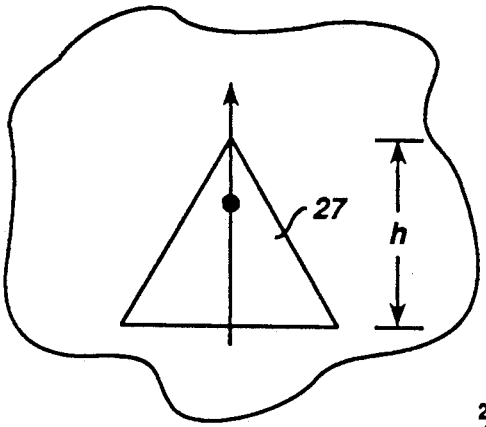
Figure 3 Prior Art
FIG. 3 is a top plan view of a prior art planar, equiangular triangular patch antenna element.

FIG. 3 illustrates an equiangular triangular patch antenna element used in prior art antenna arrays to provide a steered beam 20 swept through an arc 26. The equiangular triangular patch 27 is approximately an equilateral triangle, with all sides being equal in dimension to each other and all angles being 60 degrees. The path 27 is preferably a linearly polarized printed circuit antenna element having a height h selected based on the wavelength of the transmitted signal, as is known in the art.

Figure 4:
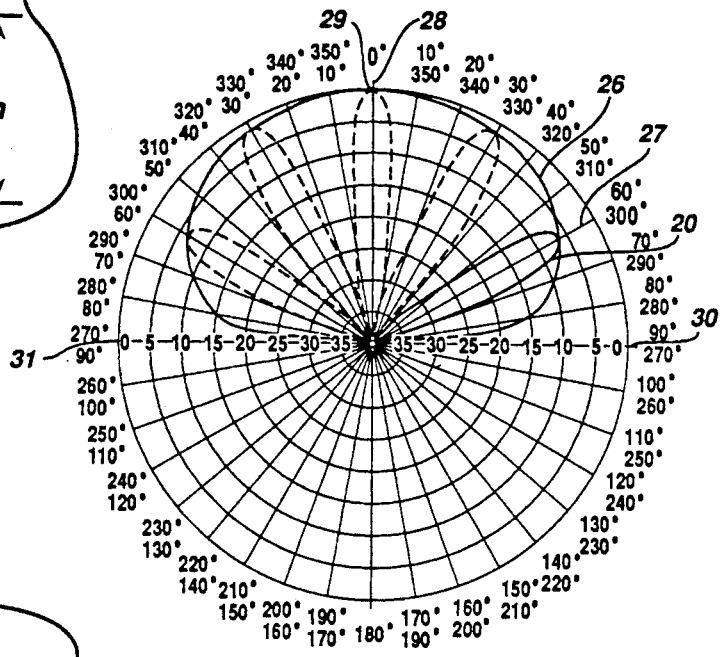
Figure 4 Prior Art

FIG. 4 illustrates the theoretical element pattern of the prior art equiangular triangular patch of FIG. 3 through which the steered beam may be swept. The radiation pattern of FIG. 4 is identical to that shown in FIG. 1. The element radiation pattern 26 defines an envelope within which the steered beam array pattern 20 may be swept. The array pattern may extend to the edge of the envelope but may not exceed the envelope at any particular position. The distance 27 of the element radiation pattern 26 from the outer edge of the polar chart represents the loss of the radiation strength in decibels from a maximum value. At the boresight portion 28, shown as zero degrees in the polar chart, the element radiation pattern 26 is at a maximum value 29.

The maximum realizable beamwidth for planar printed circuit antennas is approximately a cosine $\theta$ pattern. The steered beam 20 is scanned from boresight in either direction towards endfire point 30. Endfire is 90 degrees from boresight. The gain drops 6 decibels (dB) at 60 degrees from boresight point 28 in a planar array. After the gain has dropped greater than 6 dB, the signal is not sufficiently strong to be reliably transmitted and received for use in the military aircraft. Because the element radiation pattern suffers a scan loss of 6 dB at 60 degrees from boresight, the steered beam of the array cannot be swept more than 60 degrees from boresight. If the beam 20 is scanned greater 60 degrees from boresight, the loss due to the element pattern is sufficiently great that the signal does not have sufficient strength to be detected.

As illustrated in FIG. 1, the angle to which the steered beam can be swept forward from boresight directly affects the operating capabilities of the aircraft. The aircraft cannot detect terrain conditions or enemy installations farther ahead than the steered beam can be swept forward from boresight for a planar array mounted on the underside of an aircraft, such as array 18. The distance on the ground covered by a beam sweeping to the angle $\theta$ is given by the equation: altitude *tan $\theta$. Assuming the aircraft 10 of FIG. 1 has an altitude of 10 miles and has a prior art element radiation pattern suffering a scan loss of 6 dB at 60 degrees, the farthest forward that the terrain can be scanned is 17 miles ahead of the aircraft.

Figure 5:
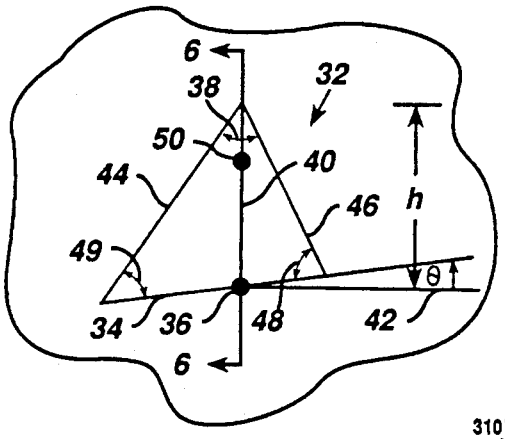
FIG. 5 is a top plan view of an asymmetrical triangular patch antenna element according to the invention.

FIG. 5 illustrates an asymmetrical triangular patch antenna element according to the invention. The asymmetrical triangular patch antenna element 32 approximates an equiangular triangular patch, as shown in FIG. 3; however, the base 34 is rotated by some angle $\theta$ about its midpoint 36. The asymmetrical triangular patch antenna element is a linearly polarized, resonant cavity antenna having the asymmetrical geometry formed over a ground plane separated by a dielectric. The base of the triangle is the radiating slot.

The antenna element 32 includes a first angle 38 which is approximately 60 degrees. A bisector 40 of the first angle 38 intersects the base 34 at a selected point 36. The angle of the baseline 34 with respect to a perpendicular 42 of the bisector o the first angle 38 defines the baseline angle $\theta$. Having the base 34 at an angle $\theta$ with respect to a perpendicular of the bisector 40 causes side 44 to increase in length while side 46 decreases in length. Angles 48 and 49, opposite the sides 44 and 46, respectively, correspondingly increase and decrease. The triangular patch antenna element 32 is therefore asymmetrical and is no longer an equiangular triangle. The point 36 is no longer the midpoint of the baseline after the baseline has been rotated by an angle $\theta$ with respect to the perpendicular 42. The angle 38 preferably remains 60 degrees, though the angle may decrease or increase in value if desired. The resonant dimension of the asymmetrical triangular path antenna element is determined by the length of the bisector from the angle 38 to the intersection with the baseline at point 36. The feedpoint 50 is preferably located adjacent the angle opposite the base 34.

The asymmetrical triangular patch 32 includes a feedpoint 50 coupled to a transmission line 52. The feedpoint is preferably a single feedpoint positioned along the bisector of the angle. A ground plane 54 separated by a dielectric 56 defines the planar microstrip antenna element. The dielectric constant and dielectric thickness (DT) affect the radiation properties of the antenna 32. The dielectric constant and thickness are selected based upon the desired frequency to be transmitted or received by the antenna element 32, as is known in the art. As is well known in the art, a radio frequency power source 35 is coupled to the transmission line 52 for causing the antenna element to emit an electromagnetic radiation pattern.

Figure 7:
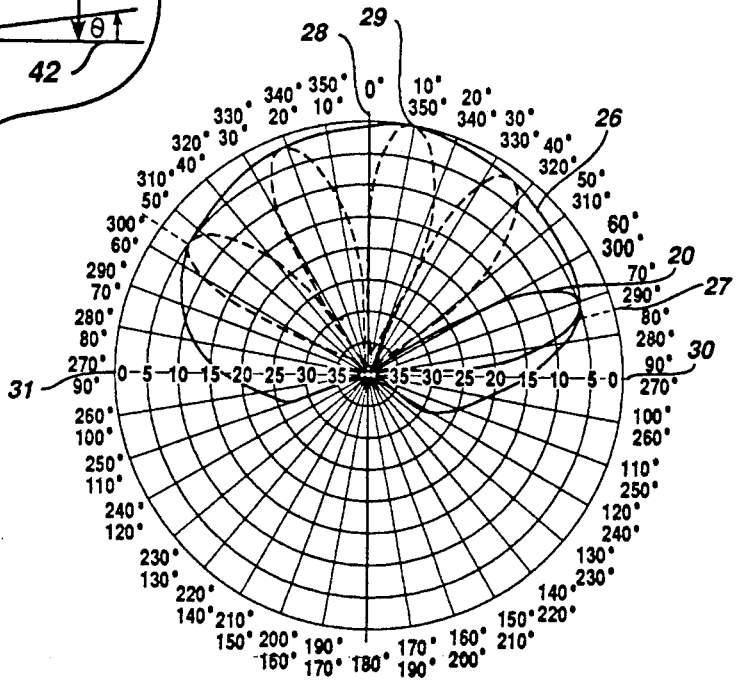
FIG. 7 is a polar chart of the measured element pattern for the asymmetrical triangular patch antenna element of FIG. 5.
Figure 6:
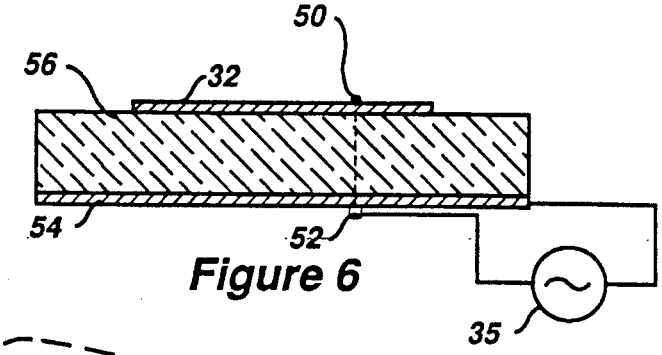
FIG. 6 is a cross-sectional view taken along lines 6—6 of FIG. 5.

FIG. 7 is a polar chart of the measured element radiation pattern for the asymmetrical triangular path antenna element of FIG. 5. The specific pattern shown is for an element have a base angle of 8 degrees and a dielectric thickness of 0.058 inch. The pattern shown is of the electric field for an 8.4 gigahertz (GHz) frequency signal. The element radiation pattern envelope 26 includes a maximum point 29 at approximately 10 degrees forward of boresight 28. The element radiation pattern suffers some scan loss proceeding from the maximum point 10 degrees from boresight toward endfire point 30. The scan loss of the element radiation pattern envelope does not drop below 6 decibels until approximately 74 degrees from boresight point 27. The main lobe 20 of the steered beam of the array may therefore be swept from boresight forward to approximately 74 degrees and still have sufficient strength. The element radiation pattern is not symmetrical and, therefore, the main beam 20 can be scanned backwards significantly less than 74 degrees, approximately to 55 degrees, as can be seen from FIG. 7.

Figure 8:
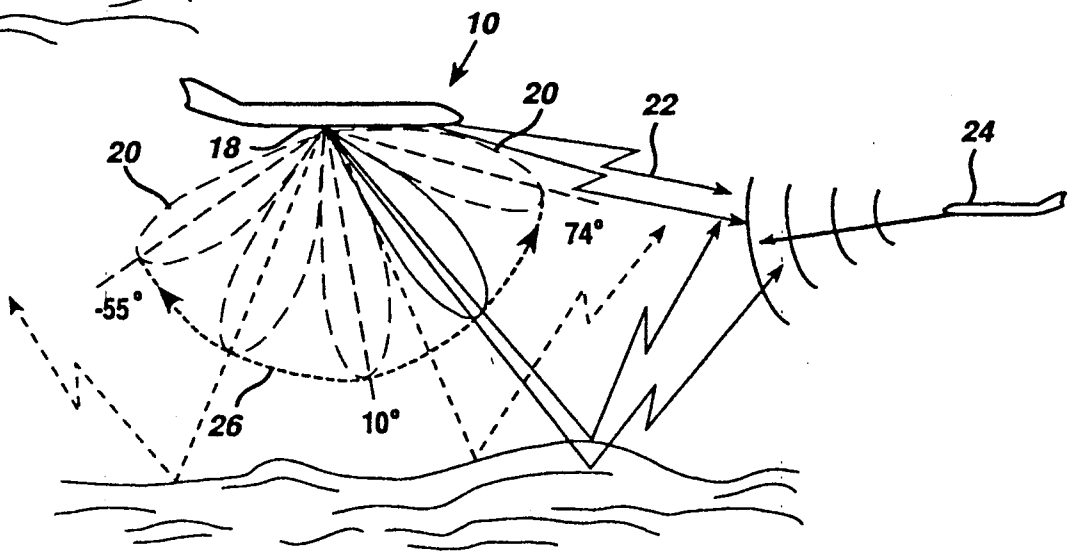
FIG. 8 is a side elevational view of an air aircraft emitting radio frequency waves from an array comprised of the asymmetrical triangular patch antenna element of the invention.

FIG. 8 illustrates the significant advantage provided by increasing the scan angle from boresight to approximately 74 degrees. As the steered beam 20 is swept forward, the terrain forward of the aircraft is scanned prior to the aircraft's passing over the terrain. Again, the distance covered on the ground is given by the equation: altitude *tan $\theta$. Assuming the aircraft is 10 miles in the air, the terrain can be scanned for a distance of approximately 35 miles forward of the aircraft. Merely by increasing the scan angle a few degrees, the range of the terrain which the aircraft radar may scan is more than doubled, providing a significant advantage in determining the nature of the terrain and the location of possible hostile installations well prior to the aircraft's passing over the terrain. Because the element radiation pattern is nonsymmetrical, the steered beam 20 is can be swept only to 55 degrees behind the plane. Because the terrain behind the plane is of significantly less interest than the terrain ahead of the plane, the operation of the aircraft on a mission is not significantly deterred by limiting the backward scan range.

The base angle of the asymmetrical triangular antenna element is selected based on the desired characteristics of the antenna array and element radiation pattern envelope. The base angle may be any value from 1 degree to in excess of 8 degrees. Table 1 illustrates value of the element radiation pattern for a range of base angles and frequencies.

TABLE 1

| | DT = 0.028" BEAM SQUINT | | |
|---|---|---|---|
| Base Angle | 8.6 GHz E/H | 8.8 GHz E/H | 9.0 GHz E/H |
| 0° | +4/−6 | +4/−1 | +3/−1 |
| 1° | +4/−6 | +3/−3 | +3/−2 |
| 2° | +4/−7 | +3/−4 | +3/0 |
| 4° | +5/−11 | +3/−8 | +2/−1 |
| 8° | +6/−22 | +6/−18 | +3/−5 |

TABLE 2

| | DT = 0.058" BEAM SQUINT | | | | | |
|---|---|---|---|---|---|---|
| Base Angle | 8.0 GHz E/H | 8.2 GHz E/H | 8.4 GHz E/H | 8.6 GHz E/H | 8.8 GHz E/H | 9.0 GHz E/H |
| 0° | +5/0 | +5/0 | +5/0 | +5/0 | +5/0 | +5/0 |
| 1° | — | — | — | +5/0 | +5/0 | +5/0 |
| 2° | — | — | — | +5/0 | +5/0 | +5/0 |
| 4° | — | — | — | +4/+1 | +3/+2 | +5/+4 |
| 8° | +22/−15 | +14/−15 | +10/−8 | +10/−3 | +7/−1 | +6/0 |

The values for Table 1 were determined using the asymmetrical patch of FIG. 5 on a dielectric thickness of 0.028 inch and a dielectric constant of 2.5. Table 2 is for the asymmetrical triangular patch antenna element having a dielectric thickness of 0.058 inch, with all other physical dimensions identical to the element 32 of Table 1. DT may be in the range of 0.01 to 0.5 $\lambda_g$ and is preferably between 0.02 $\lambda_g$. $\lambda_g$ is the wavelength of the signal in the dielectric. $\lambda_g=\lambda_o\sqrt{E_r}$, where $\lambda_o$ is the wavelength of the signal in free space having a dielectric constant of 1 and $E_r$ is the dielectric constant of the material. The beam squint angle at which the gain drops by 6 dB and other characteristics vary considerably based on changes in DT. Angles forward of boresight are labeled "positive angles," whereas angles aft of boresight are labeled "negative angles." However, whether the angle is forward or aft of boresight is not critical to the functioning of the invention. If the properties aft of the boresight are desired for use forward of the aircraft, the individual antenna elements 32 may merely be flipped over to reverse the relationship of the pattern, or vice versa.

The values of the E-cut represent the radiation pattern of the electric field as the signal propagates. The values for the H-cut represent the radiation pattern of the magnetic field as the signal propagates. As is known in the art, electromagnetic radiation includes an electric field and a magnetic field, perpendicular to each other. In the asymmetrical triangular patch antenna element, the radiation pattern for the electric field is different from the element radiation pattern for the magnetic, and both vary with the base angle $\theta$.

The beam squint angle is the angle at the midpoint between the 3-dB beam width. Generally, the midpoint of the 3-dB beam width represents a maximum value for the element radiation pattern. For example, the maximum point 29 of the element radiation pattern is approximately 10 degrees forward from boresight point 28, as can be seen from Table 2 and FIG. 7, for a base angle of 8 degrees and a frequency of 8.4 GHz.

FIGS. 9–13 plot the element radiation pattern for the elements of Table 1 at the selected frequencies. The graphs of FIGS. 9–13 are for the same type of element radiation pattern as shown in FIG. 7. However, the plot is made on a rectangular coordinate plot rather than a polar coordinate. In the event a polar coordinate graph were used, the plot would look very similar to the plot of FIG. 7. Each of the element radiation patterns 26 of FIGS. 9–13 includes a maximum point 29. The distance of the maximum point 29 from the boresight point 28 is directly related to the beam squint for an element having the selected base angle. For example, as can be seen from FIG. 12B, the H-cut in an element having a base of angle of 4 degrees has a beam squint of −11 degrees. That is, the maximum point 29 of the array is approximately 11 degrees behind the boresight. The E-cut pattern for the same array has a beam squint of approximately +5 degrees. A patch having a base angle of 8 degrees experiences a greater beam squint than a patch having a base angle of less than 8 degrees.

Figure 14:
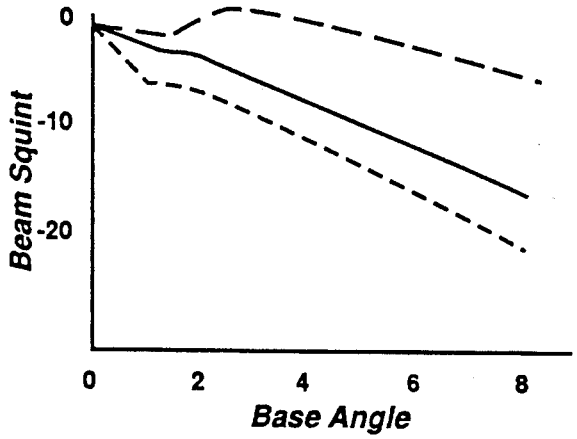
FIG. 14 is a graph plotting the beam squint values of Table 1 for the H-field.

FIG. 14 plots the value for the beam squint of the H-cut for the triangular patch element of Table 1. As illustrated in FIG. 14, as the base angle increases, the beam squint generally increases linearly. Further, for lower frequencies, the beam squint is generally greater.

Another significant parameter is the angle at which the element radiation pattern suffers a loss of 6 dB. Table 3 lists the measured values of the angle at which the element radiation pattern exhibited a loss of 6 dB from boresight.

TABLE 3

| Base angle | 8.6 GHz | 8.8 GHz | 9.0 GHz |
|---|---|---|---|
| 0° | −55° | −57° | −57° |
| 1° | −58° | −58° | −58° |
| 2° | −58° | −58° | −55° |
| 4° | −60° | −60° | −60° |
| 8° | −65° | −65° | −60° |

Figure 10A:
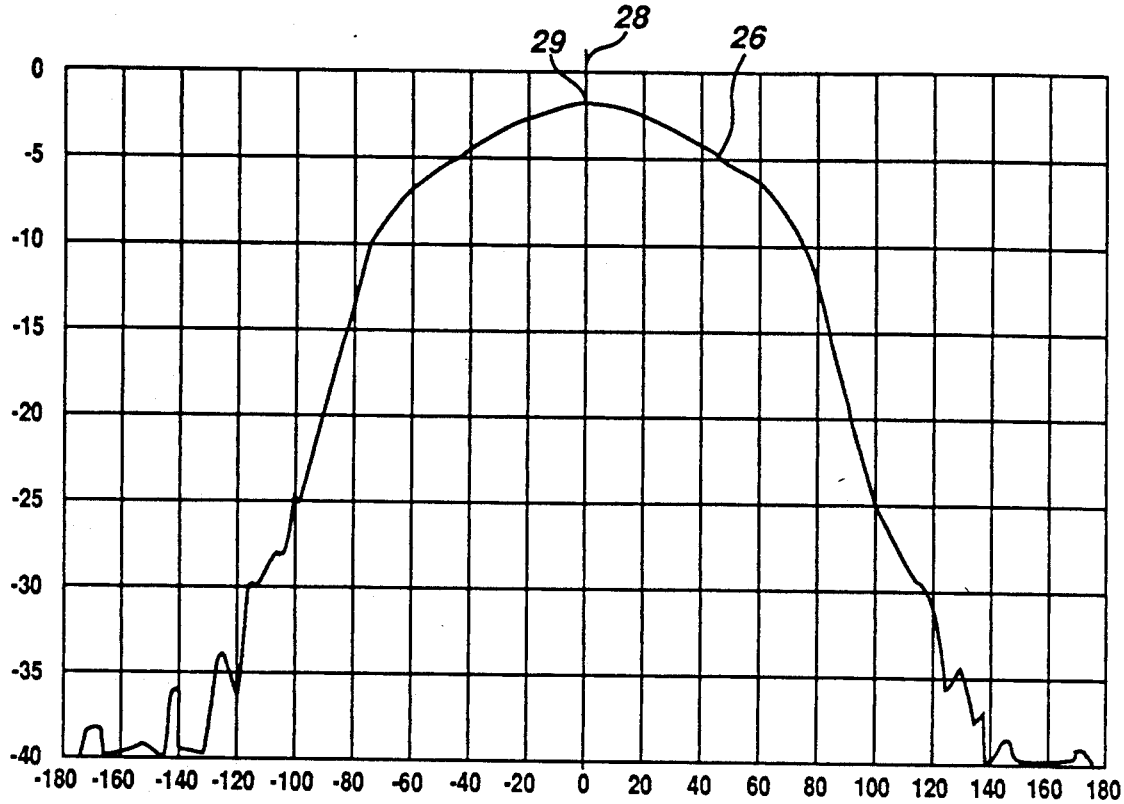
FIGS. 10A and 10B are graphs of the asymmetrical triangular patch antenna element having a base angle of one degree.
Figure 10B:
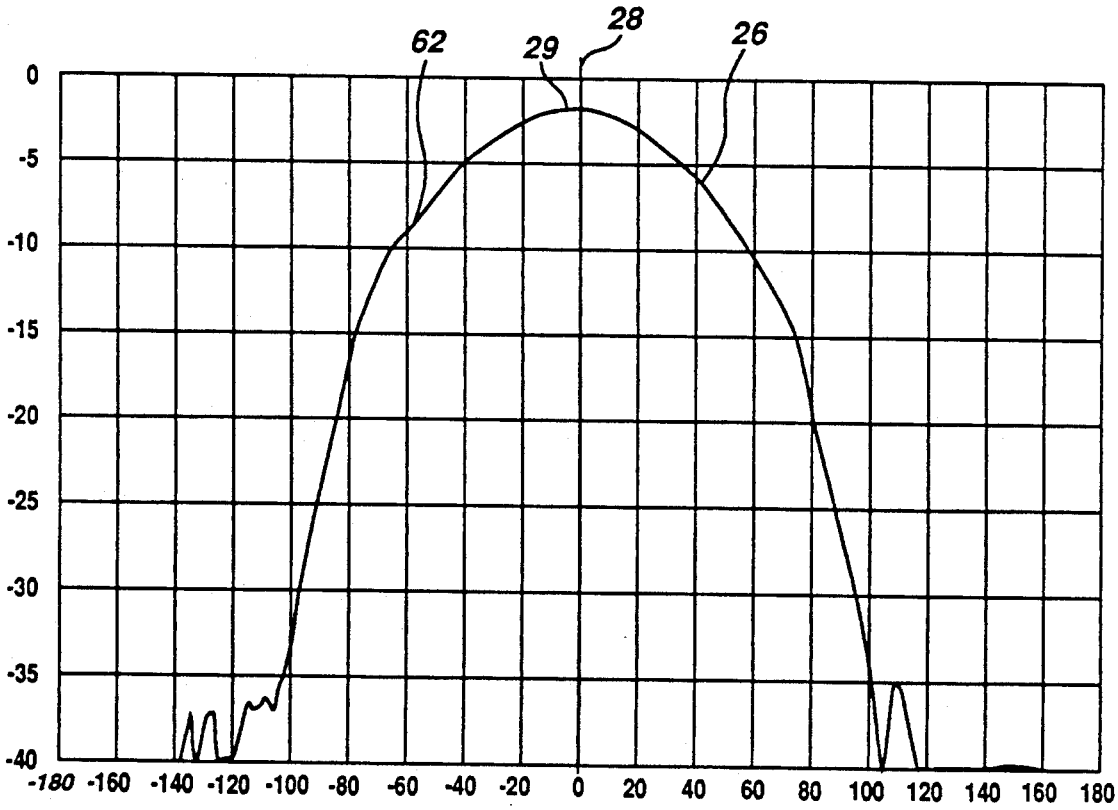
Figure 11A:
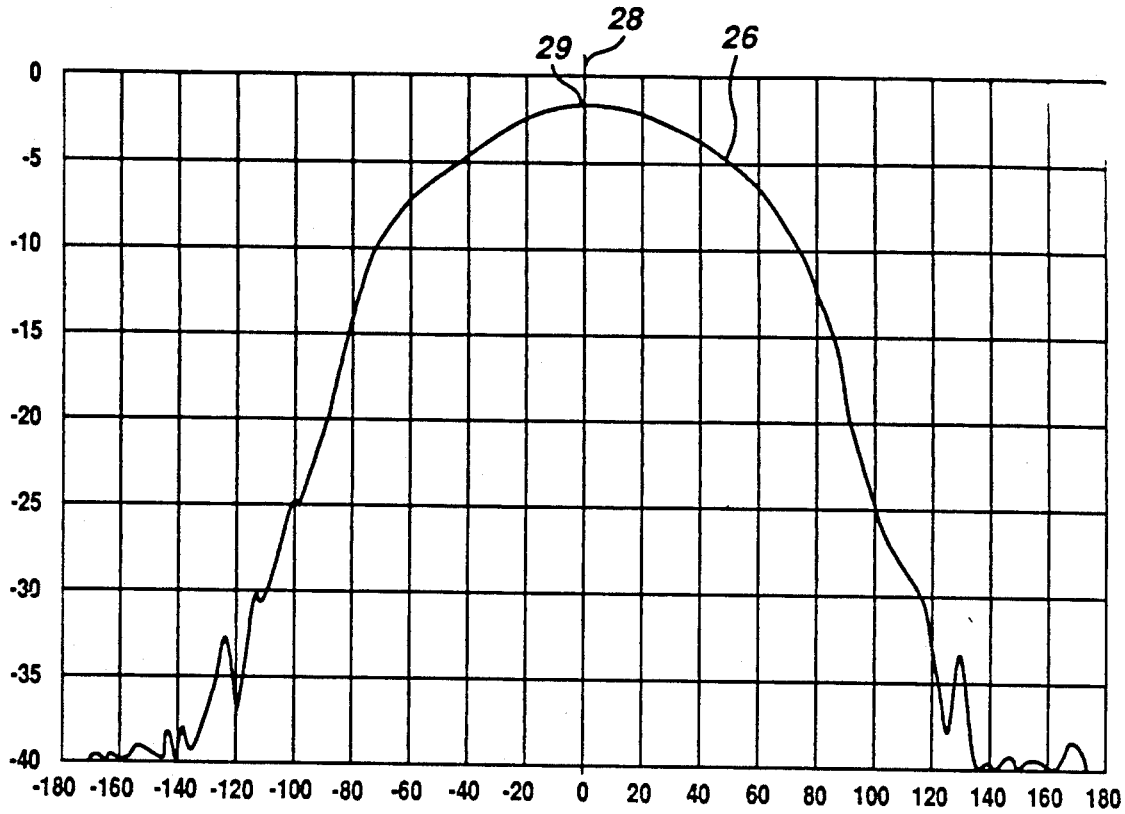
FIGS. 11A and 11B are graphs of the asymmetrical triangular patch antenna element pattern having a base angle of two degrees.
Figure 11B:
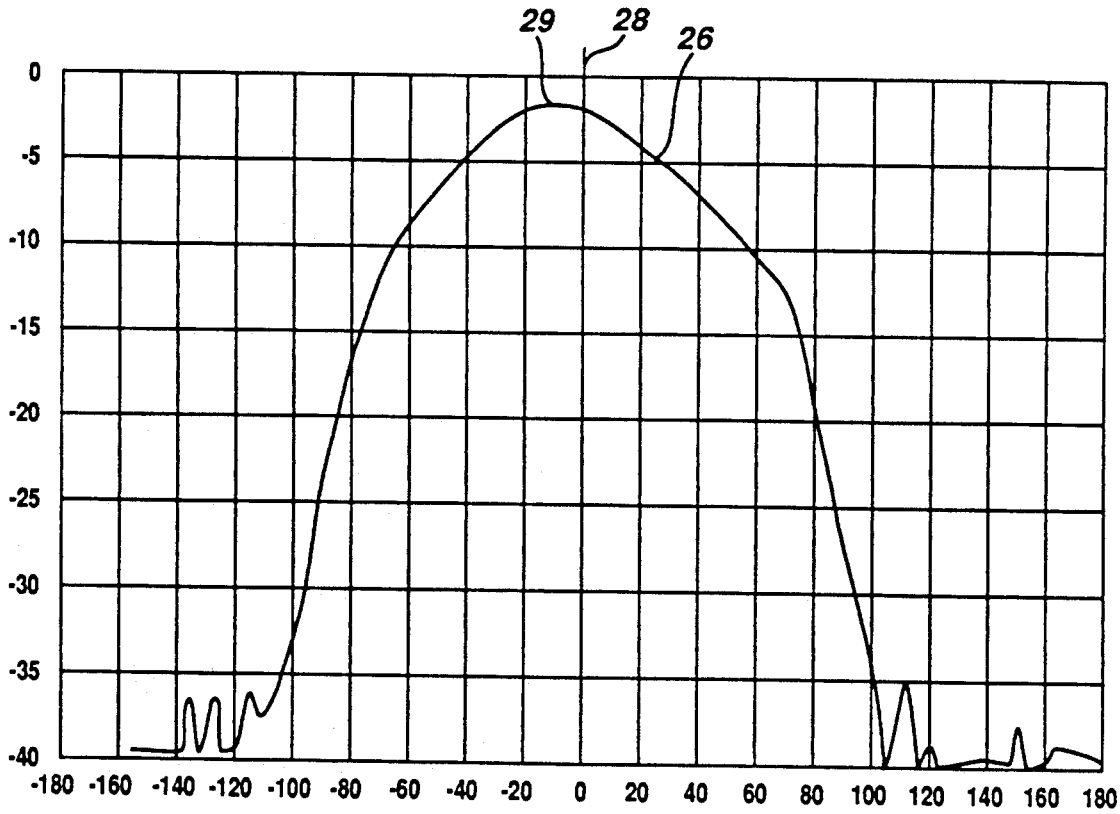
Figure 12A:
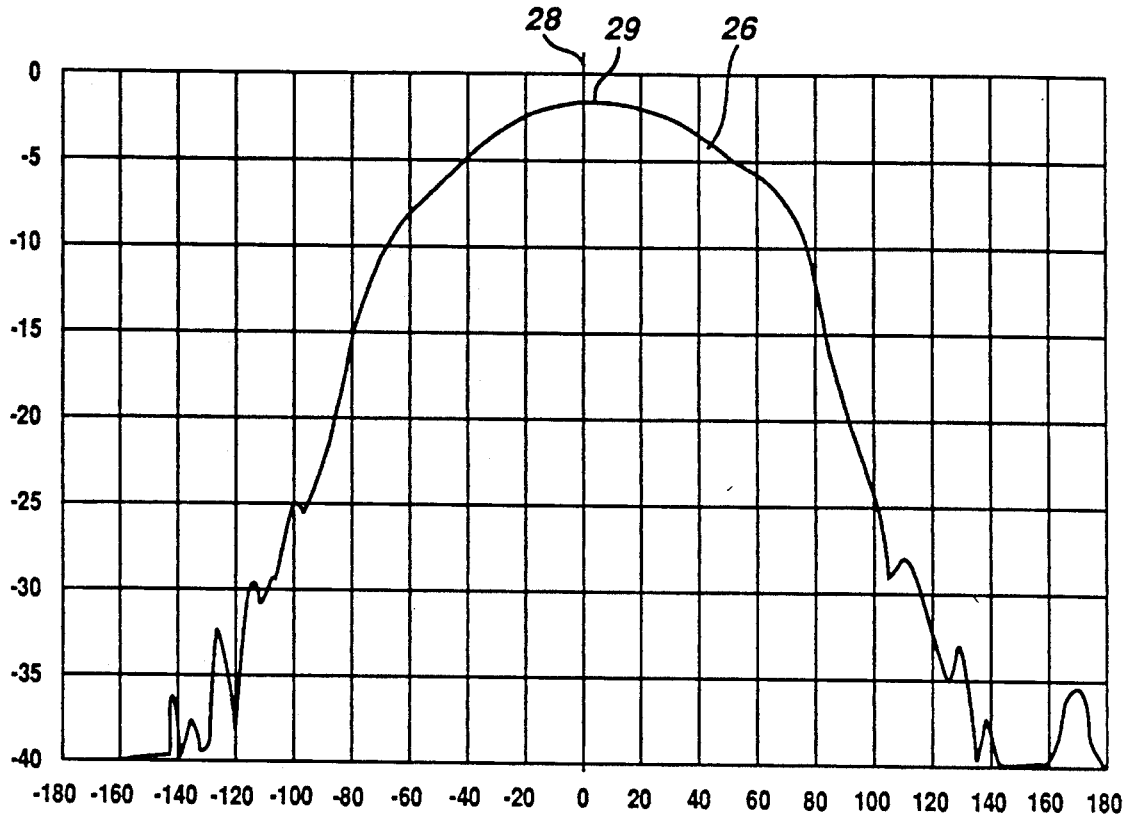
FIGS. 12A and 12B are graphs of the asymmetrical triangular patch antenna element pattern having a base angle of four degrees.
Figure 12B:
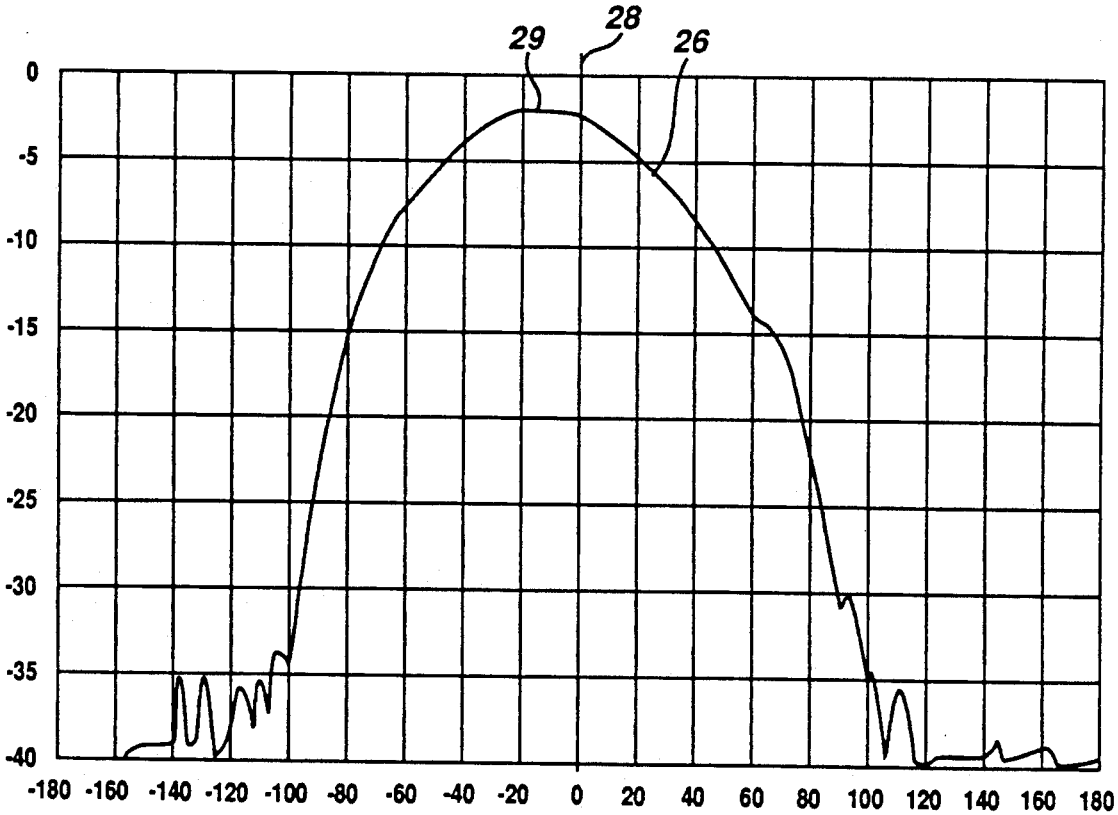
Figure 13A:
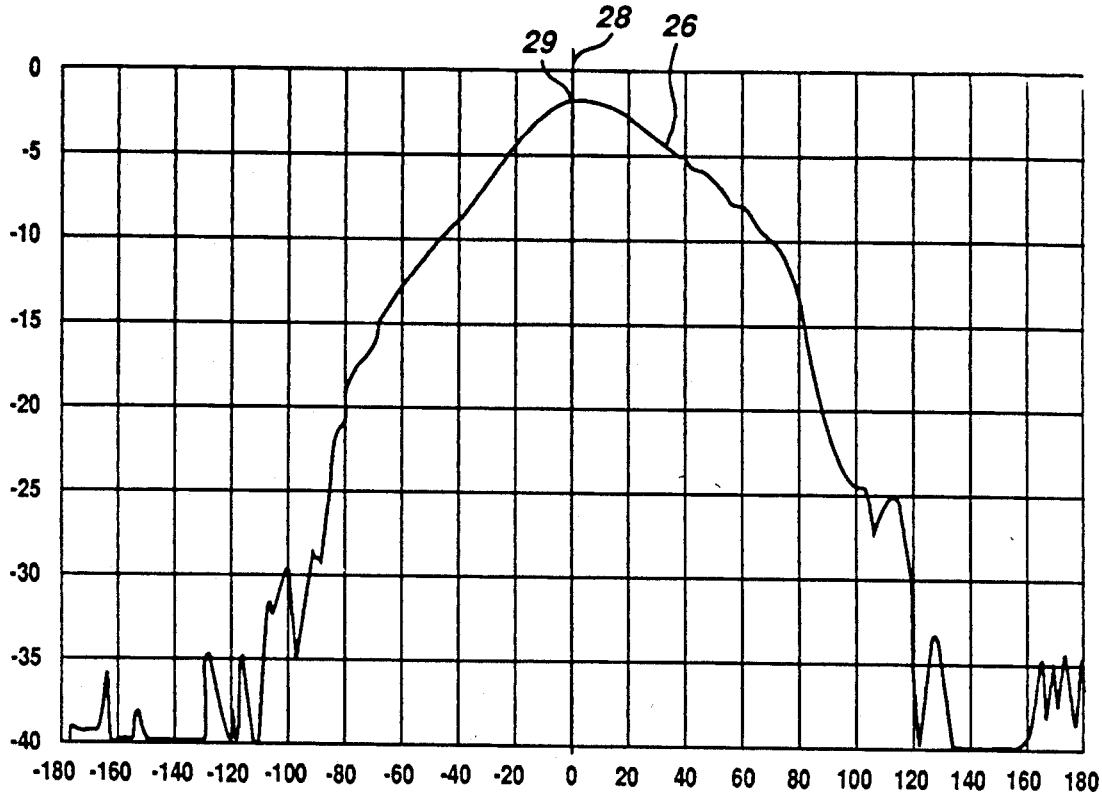
FIGS. 13A and 13B are graphs of the asymmetrical triangular patch antenna element pattern having a base angle of eight degrees.
Figure 13B:
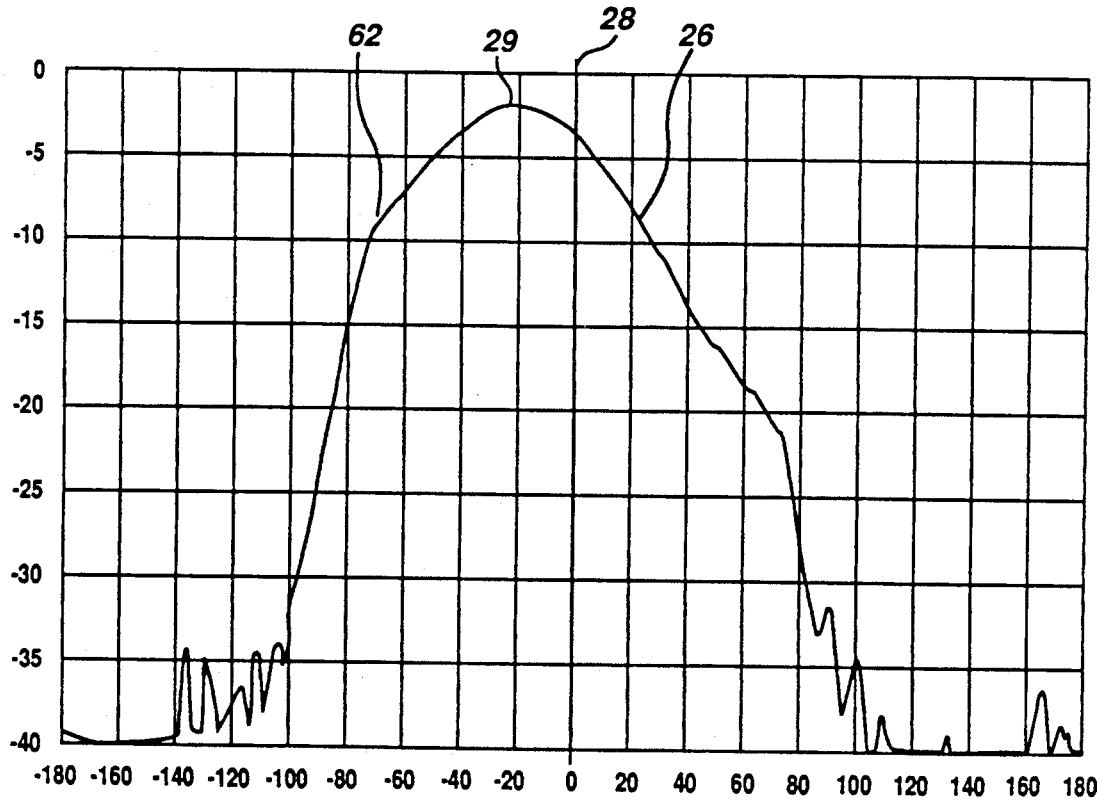

Table 3 is for the H-cut of an asymmetrical triangular patch antenna element having a dielectric thickness of 0.028 inch. The actual values shown in Table 3 were taken from FIGS. 9–13. For example, in FIG. 9B, point 62 illustrates the point at which the element radiation pattern envelope has decreased 6 dB from the maximum value at point 29. If the prior art element radiation pattern of FIG. 9B were used in the aircraft of FIG. 8, the aircraft would only be able to sweep forward 55 degrees. After 55 degrees, the loss due to the element radiation pattern would prevent the signal from being sufficiently strong. For a base angle of 1 degree, as illustrated in FIG. 10B and Table 3, the signal decreases to 6 dB from the maximum value at approximately −58 degrees from boresight. For a base angle of 8 degrees, the element radiation pattern reaches −65 degrees before decreasing below 6 decibels. As previously described, the range is sufficiently increased by raising the scan angle a few degrees.

Figure 15:
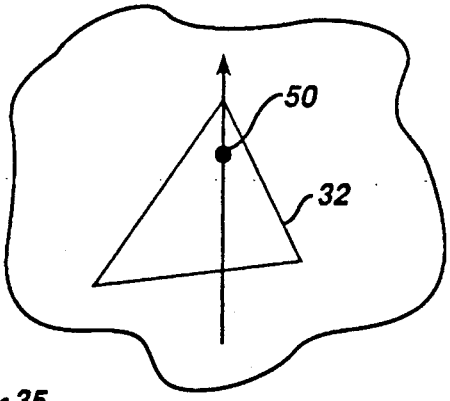
FIG. 15 is a top view illustrating the antenna polarization configuration for an H-cut.
Figure 16:
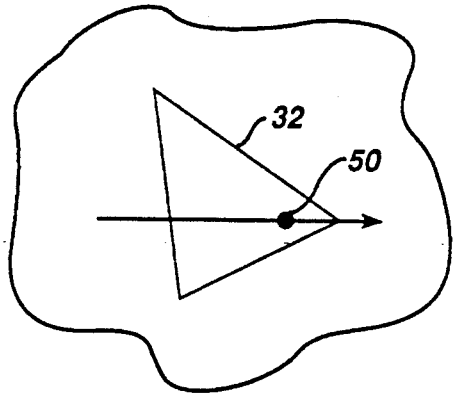
FIG. 16 is a top plan view of the antenna polarization configuration for an E-cut.

FIGS. 15 and 16 illustrate possible antenna polarization configurations. The radiation pattern is preferably a linearly polarized pattern rather than a circularly polarized pattern. However, if desired, and the appropriate transmission signals are provided, the radiation pattern could be a circularly polarized pattern. FIG. 15 illustrates the preferred orientation of the element 32 in the direction of radiation E for transmitting and receiving a vertically polarized radiation pattern. FIG. 16 illustrates the orientation of the element 32 for the transmission and receiving of a horizontally polarized radiation pattern. While a single feed line 50 is shown, a microstrip feed line could be provided if desired.

Figure 17:
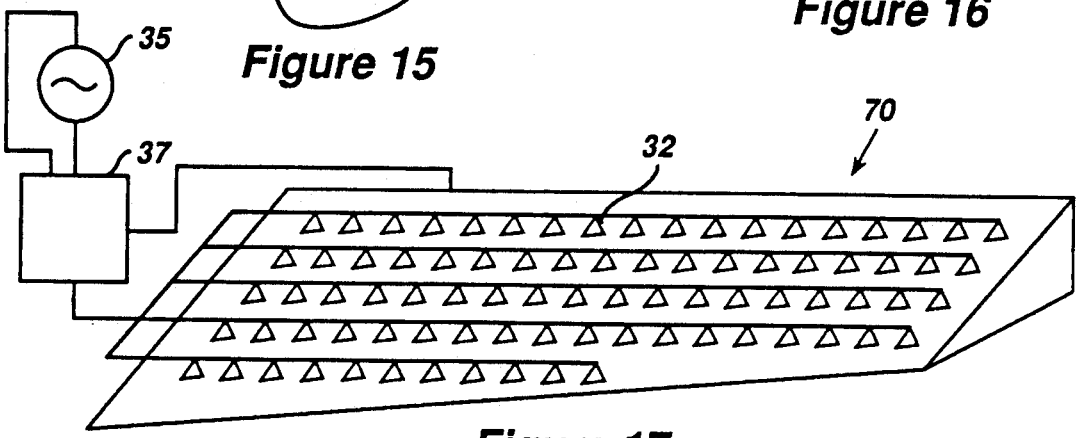
FIG. 17 is an isometric view of an array formed from a plurality of the asymmetrical triangular patch antenna elements of FIG. 5.
Figure 9A:
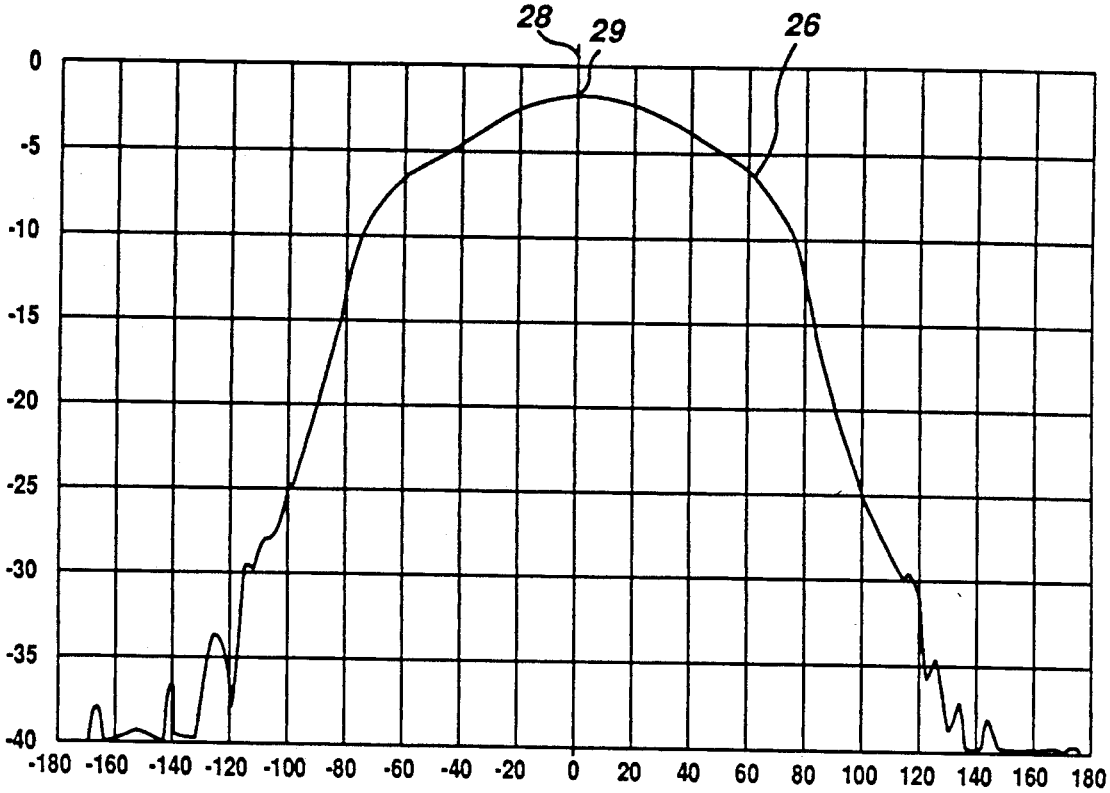
FIGS. 9A and 9B are graphs of the prior art triangular patch antenna element pattern.
Figure 9B:
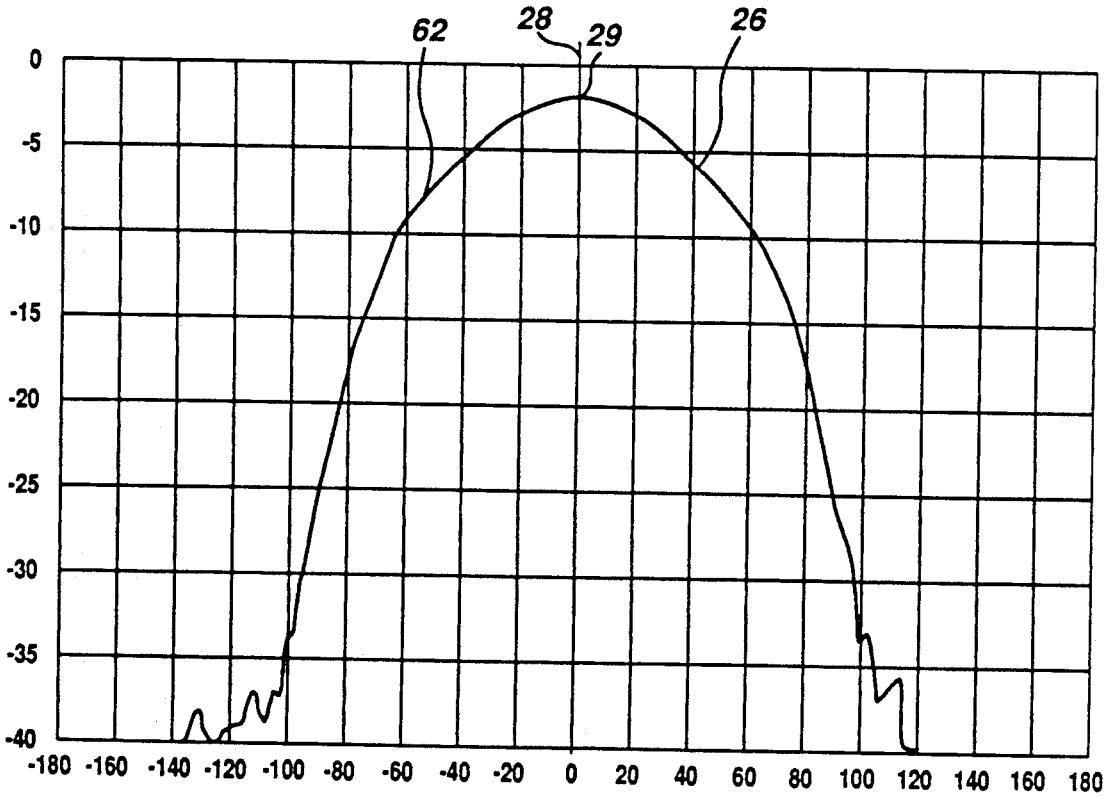

An array comprised of a plurality of the asymmetrical triangular patch antenna elements 32 is illustrated in FIG. 17. The array is preferably formed from a plurality of printed circuit antenna elements 32, as previously shown and described with respect to FIGS. 5, 6, 15 and 16. The planar elements conform to the surface of the aircraft upon which they are mounted, whether it be the underside of the wing, the topside of the wing, the topside of the fuselage, the underside of the fuselage, or some other aircraft structure corresponding to arrays 12, 14, 16 and 18 of FIG. 1. The antenna is a low-profile, planar antenna permitting the steered beam to be scanned nearer to endfire than previously possible in the prior art. The array 70 of FIG. 17 is provided with a plurality of transmission lines (not shown), a transmission line respectively coupled to each antenna element for transmitting and receiving power. Positioned beneath each element 32 of the array 70 is a dielectric layer (not shown) and a ground plane (not shown) The dielectric layer may be a common dielectric for all elements 32 in the array 70. The ground plane may also be a common ground plane for all elements 32 in the array 70. Alternatively, an individual dielectric layer (not shown) and ground plane (not shown) may be provided for each element 32 in the array 70. If individual dielectric layers are provided for each element 32, the dielectric thickness may be different from element to element within the array. A radio frequency power source is coupled to the transmission line, causing the antenna elements to individually emit the desired electromagnetic radiation energy pattern. The main beam 20 of the array is shaped and steered and scanned using any one of a number of techniques presently available in the art. As is well known in the art, a radio frequency power source 35 is coupled via transmission lines to the individual antenna elements to cause them to emit an electromagnetic radiation pattern. As is also known in the art, an electronic control means 37 is provided for scanning the steered beam from a position forward of the aircraft 10 to a position aft of the aircraft 10. A suitable radio frequency power source 35 and scanning means 37 may be selected from those devices which are readily available in the market and well known to those of ordinary skill in the art.

I claim:

1. A planar microstrip antenna structure having a low physical profile, comprising:

an electrically conductive ground plane;

a dielectric layer overlying said ground plane;

an electrically conductive antenna element coupled to a second side of said dielectric layer, said antenna element having triangular shape with a first angle and a base opposite said first angle, a second angle and a second side opposite said second angle, a third angle and a third side opposite said third angle, said first angle being approximately 60° and said base being at a selected angle greater than 3° with respect to the perpendicular to a bisector of said first angle, said antenna element adapted to emit a radiation envelope pattern that is asymmetrical about boresight, the gain of said envelope pattern remaining within 6 decibels of the maximum gain to an angle at least 60° forward from boresight toward endfire; and a transmission line coupled to said antenna element.

2. The antenna according to claim 1, further including a radio frequency power source coupled to said transmission line for causing said antenna element to emit an electromagnetic radiation energy pattern.

3. The antenna according to claim 1 wherein said selected angle is greater than 7°.

4. The antenna according to claim 1 wherein said second angle is approximately 60° plus said selected angle and said third angle is 60° minus said selected angle, said second side being longer than said first side and said third side being shorter than said first side.

5. The antenna according to claim 1 wherein said transmission line is coupled to said antenna element adjacent said first angle.

6. The antenna according to claim 1 wherein the maximum value of said radiation energy pattern is spaced from boresight by a given angle.

7. The antenna according to claim 6 wherein said given angle is greater than 20°.

8. The antenna according to claim 1 wherein the gain of said energy pattern decreases by less than 6 dB of its maximum value from boresight to a point 70° from boresight in a selected direction.

9. The antenna according to claim 1 wherein said antenna structure includes an array having a plurality of said antenna elements and beam steering means for steering the energy propagated by said array, said beam steering means sweeping a peak of said pattern from a position greater than 50° aft of boresight to a position greater than 70° forward of boresight.

10. A planar microstrip antenna array mounted on an aircraft fuselage having a low physical profile, comprising:

at least one electrically conductive ground plane;

at least one dielectric layer overlying said ground plane;

a plurality of individual antenna elements coupled to a second side of said dielectric layer, said elements being formed in an array, each of said elements having a plurality of sides and a plurality of angles, the element structure along a bisector of a first angle extending from said first angle to a base side opposite side first angle forming a resonant dimension of said antenna element, said base side forming a radiating slot of said antenna element, said base side being at a selected base angle with respect to a perpendicular of said bisector to provide an asymmetrical radiating element pattern having a gain that remains within 6 decibels of the maximum gain at 60° forward from boresight, toward endfire; and a transmission line coupled to each of said antenna elements.

11. The planar microstrip antenna array of claim 10, further comprising:

means for selectively applying a radio frequency signal to said elements to produce a steered beam; and means for scanning said steered beam from a position forward of said aircraft to a position aft of said aircraft.

12. The planar microstrip antenna array of claim 10 wherein said individual antenna element is a triangular shaped element having three angles and three sides, a side being opposite each of said angles.

13. The planar microstrip antenna array of claim 10 wherein the gain for pattern radiated by said array remains within 6 decibels of the maximum gain from a position 55° aft of boresight to a position 70° forward of boresight.

14. The planar microstrip antenna array of claim 10 wherein a single dielectric is provided for all elements and said dielectric thickness is in the range of 0.01 $\lambda_g$ to 0.5 $\lambda_g$, where $\lambda_g$ is the wavelength in the dielectric.

15. The planar microstrip antenna array of claim 10 wherein said base angle is in the range of 1° to 10°.

16. The planar microstrip antenna array of claim 10 wherein said base angle is in the range of 4° to 8°.

17. The planar microstrip antenna array of claim 10, further including a single common ground plane for all of said plurality of elements.

18. A planar microstrip antenna structure having a low physical profile, comprising:

an electrically conductive ground plane;

a dielectric layer overlying said ground plane;

an electrically conductive antenna element overlying said dielectric layer, said antenna element having a generally triangular shape with a first angle and a base opposite side first angle, a second angle and a second side opposite said second angle, a third angle and third side opposite side third angle, said first angle being approximately 60°, said base and said second side being elongated with respect to said third side, said third side being shorter in length than said base and said second side, said third angle being less than 60° and said second angle being greater than 60° to provide an asymmetrical radiating element pattern having a gain that remains within 6 decibels of the maximum gain at 60° forward from boresight, towards endfire.

19. The planar microstrip antenna structure according to claim 18, wherein said gain for said radiation pattern remains within 6 decibels of the maximum gain for the entire range from a position greater than 50° aft of boresight to a position greater than 60° forward from boresight.

* * * * *